US007687735B2

(12) United States Patent
Chien et al.

(10) Patent No.: US 7,687,735 B2
(45) Date of Patent: Mar. 30, 2010

(54) PACKAGING STRUCTURE FOR DEPRESSION SWITCHES

(75) Inventors: Ming-Chih Chien, Taoyuan County (TW); Jung-Hsiu Chen, Taoyuan County (TW)

(73) Assignee: Sipix Technology Inc., Taoyuan County (TW)

( * ) Notice: Subject to any disclaimer, the term of this patent is extended or adjusted under 35 U.S.C. 154(b) by 49 days.

(21) Appl. No.: 12/130,554

(22) Filed: May 30, 2008

(65) Prior Publication Data

US 2009/0294264 A1 Dec. 3, 2009

(51) Int. Cl.
*H01H 13/715* (2006.01)

(52) U.S. Cl. ..... 200/515; 200/406; 200/516

(58) Field of Classification Search ..... 200/406, 200/512, 515, 516
See application file for complete search history.

(56) References Cited

U.S. PATENT DOCUMENTS

| | | | | |
|---|---|---|---|---|
| 5,901,834 | A | 5/1999 | Inubushi et al. | |
| 6,066,812 | A | 5/2000 | Lee | |
| 6,441,330 | B2 | 8/2002 | Liao | |
| 6,531,671 | B2 | 3/2003 | Yeh | |
| 6,548,778 | B2 * | 4/2003 | Takahashi | 200/516 |
| 6,548,779 | B2 * | 4/2003 | Takahashi et al. | 200/516 |
| 6,593,537 | B2 * | 7/2003 | Teruyama et al. | 200/515 |
| 6,618,022 | B2 * | 9/2003 | Harvey | 343/876 |
| 6,791,480 | B1 | 9/2004 | Uke | |
| 6,917,007 | B2 * | 7/2005 | Hirai et al. | 200/516 |
| 6,924,447 | B2 | 8/2005 | Lu et al. | |
| 6,982,394 | B2 * | 1/2006 | Ide et al. | 200/516 |
| 7,075,020 | B2 | 7/2006 | Asada | |
| 7,145,092 | B2 | 12/2006 | Tuhkala | |
| 7,399,937 | B2 * | 7/2008 | Nishimura, Takahiro | 200/314 |

* cited by examiner

*Primary Examiner*—Michael A Friedhofer
(74) *Attorney, Agent, or Firm*—Muncy, Geissler, Olds & Lowe, PLLC

(57) ABSTRACT

A packaging structure for depression switches includes an electronic substrate containing at least one switch electrode, a push-on switch located on the electronic substrate to connect the switch electrode to generate a command signal and a sealing member. The push-on switch and the electronic substrate form a first air chamber between them. The sealing member has a fastening portion to seal the push-on switch on the electronic substrate and a second air chamber formed with the electronic substrate to communicate with the first air chamber. By depressing the push-on switch to connect the switch electrode, air held in the first air chamber is squeezed and flows to the second air chamber without escaping.

9 Claims, 4 Drawing Sheets

PACKAGING STRUCTURE FOR DEPRESSION SWITCHES

FIELD OF THE INVENTION

The present invention relates to a packaging structure and particularly to a packaging structure for depression switches.

BACKGROUND OF THE INVENTION

Metal dome switch is a thin switch widely used on mobile communication devices, input devices of computer systems or IC cards. It usually contains a thin and arched metal blade and can provide metallic characteristics such as electric conductivity and elasticity.

During manufacturing processes to install the metal dome switch on a printed circuit board (PCB in short hereinafter), air often is trapped in the metal dome switch. The trapped air makes depression of the switch difficult and click feeling suffered. Many techniques have been proposed to expel the air trapped in the metal dome switch. References can be found in U.S. Pat. Nos. 5,901,834, 6,441,330, 6,531,671, 6,917,007, 6,982,394 and 7,145,092. They mostly have an opening or a conduit formed on the bounding surface between the metal dome switch and the PCB to allow the air to flow out, so that depression quality of the metal dome switch is not affected by the air trapped inside.

However, the conventional techniques mentioned above cannot be used on IC cards embedded with a metal dome switch. FIGS. 1A and 1B illustrate a conventional IC card 1. It has a metal dome switch 2 located on a PCB 3 corresponding to electrodes located thereon. The PCB 3 is evenly coated with an adhesive tape 4 to bond the metal dome switch 2. The electrodes include a peripheral electrode 5 and a trigger electrode 6 located in the peripheral electrode 5. The metal dome switch 2 has the periphery in contact with the peripheral electrode 5 in regular conditions. When the metal dome switch 2 is depressed, the center portion thereof is moved downwards until touching the trigger electrode 6 as shown in FIG. 1B, then a conductive connection is formed between the peripheral electrode 5 and the trigger electrode 6 through the metal dome switch 2 to generate an electric signal. When the depressing force is released, the metal dome switch 2 bounces back to its original position due to metal elasticity, then the connection between the peripheral electrode 5 and trigger electrode 6 is broken. As the metal dome switch 2 and the PCB 3 are integrally sealed in the IC card 1, air also is trapped between the metal dome switch 2 and the PCB 3. Depressing the metal dome switch 2 forcefully, the air will spill to the periphery where the adhesive tape 4 is located, or even pass through the adhesive tape 4, and an air bubble 7 or a gap is formed in the IC card 1 as shown in FIG. 1B. As a result, a packaging and sealing defect occurs. This will cause disintegration of the structure of the IC card 1, and also impact normal function of the PCB 3.

SUMMARY OF THE INVENTION

The primary object of the present invention is to provide a packaging structure for depression switches to prevent loss of air in a metal dome switch under depression. To achieve the foregoing object, the packaging structure of the invention includes an electronic substrate with at least one switch electrode located thereon, a push-on switch located on the electronic substrate to connect the switch electrode to generate a command signal, and a sealing member. The push-on switch and the electronic substrate form a first air chamber between them. The sealing member has a fastening portion to seal the push-on switch on the electronic substrate and a second air chamber between the electronic substrate and thereof communicating with the first air chamber.

In one aspect, the fastening portion is bonded to the electronic substrate and push-on switch at a bonding surface with an adhesive layer formed thereon. The fastening portion has a depressing zone to cover the push-on switch.

In one embodiment of the invention, the second air chamber is located in the fastening portion.

In another embodiment, the first air chamber and the second air chamber are formed about the same size.

In another aspect, the packaging structure for depression switches is used on an electronic device which may be an IC card or RFID (Radio Frequency Identification) tag.

By means of the invention, when the push-on switch is depressed to connect the switch electrode, the first air chamber is squeezed and the air inside flows to the second air chamber. When the depressing force is released, the air in the second air chamber flows back to the first air chamber. Hence the air held inside the switch does not flow out to the IC card and does not damage the packaging structure thereof. Moreover, the air pressure resulting from the air flowing back from the second air chamber to the first air chamber can quickly return the push-on switch to its original condition and improve the response speed of the push-on switch.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1A:
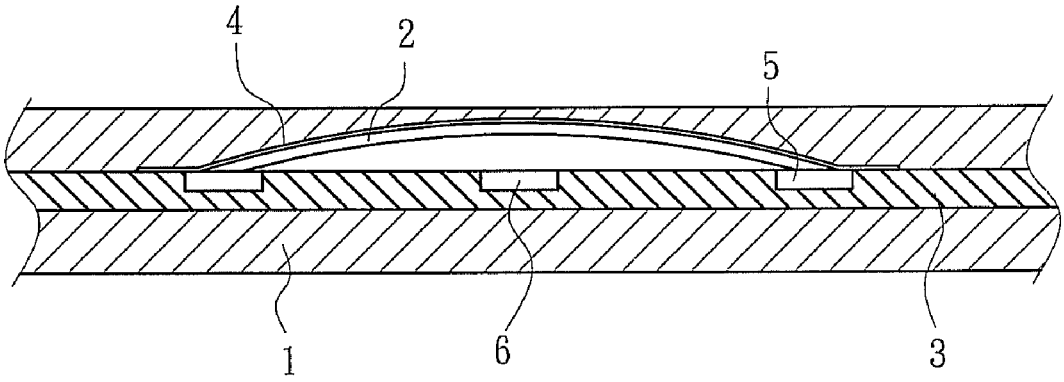
Fig. 1A PRIOR ART
FIGS. 1A and 1B are sectional views of a conventional metal dome switch adopted on an IC card.
Figure 1B:
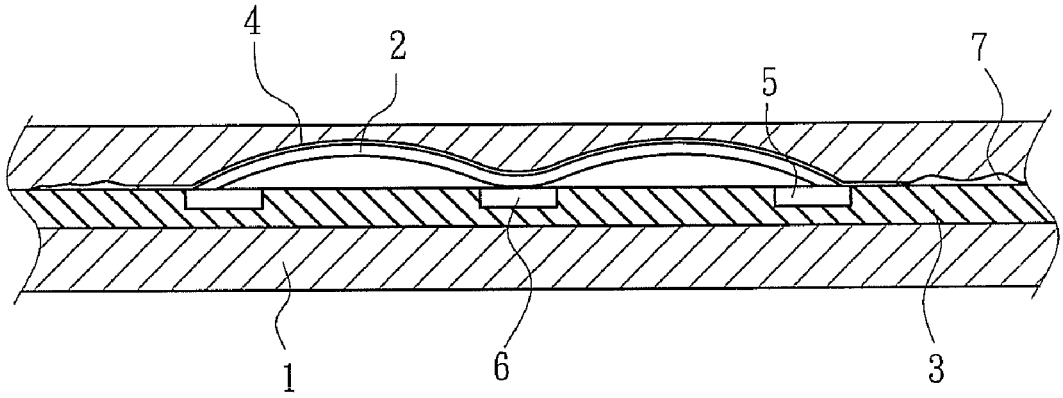
Fig. 1B PRIOR ART
Figure 2:
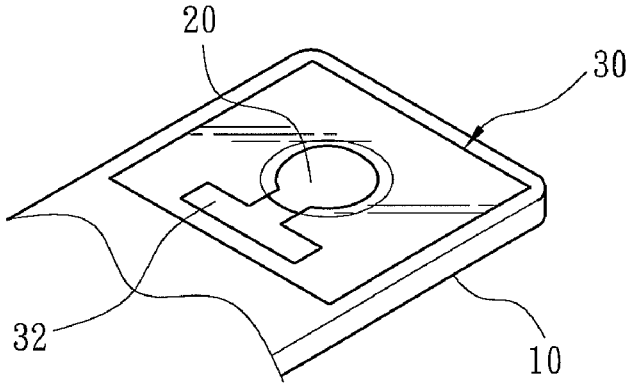
FIG. 2 is a perspective view of an embodiment of the packaging structure for depression switches of the invention.
Figure 3:
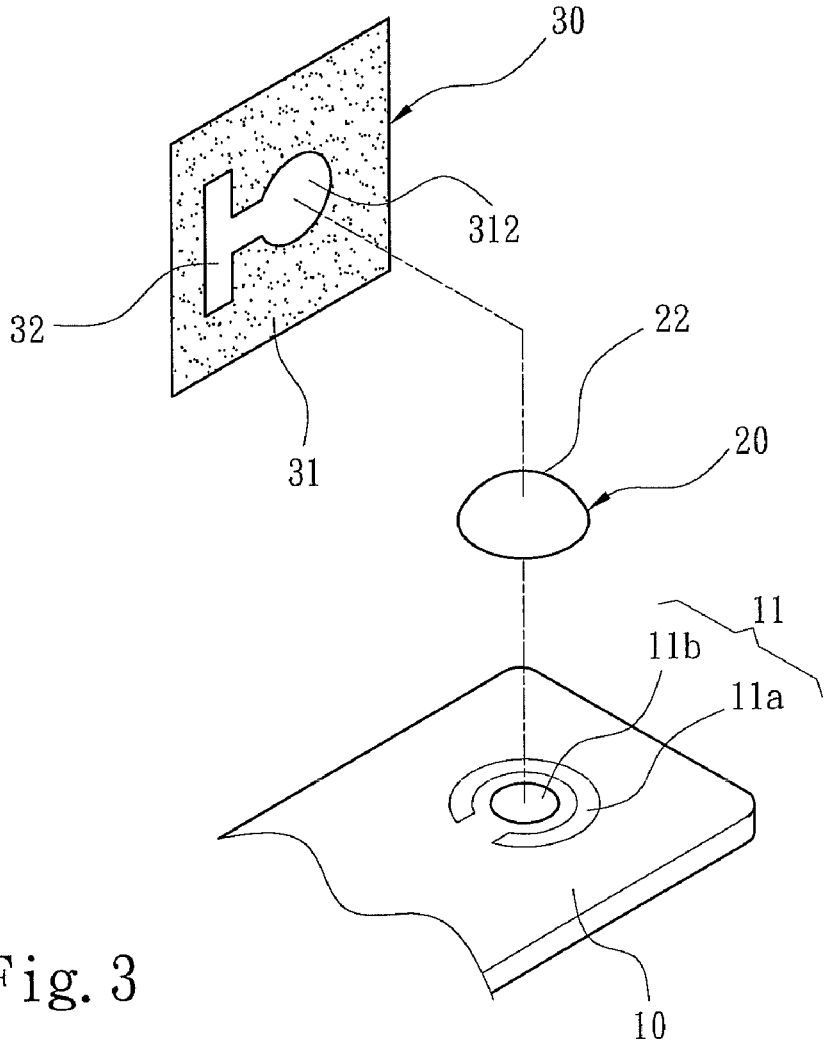
FIG. 3 is an exploded view of an embodiment of the packaging structure for depression switches of the invention.
Figure 4A:
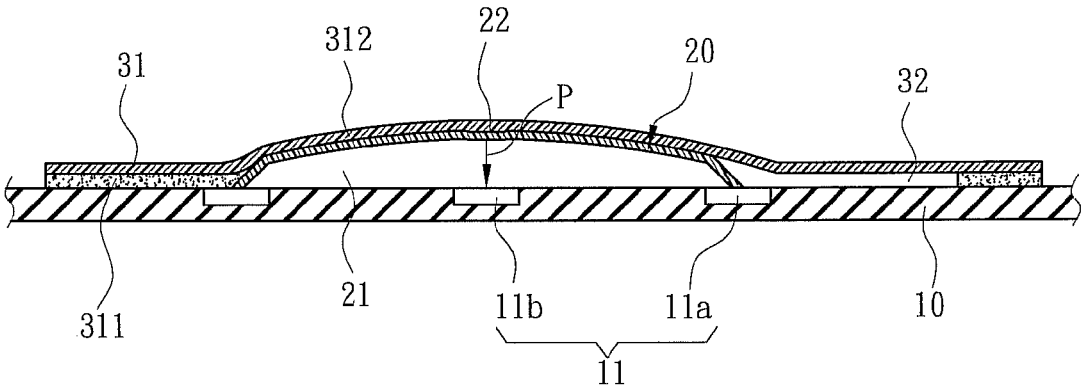
FIGS. 4A and 4B are sectional views of an embodiment of the packaging structure for depression switches of the invention.

Please refer to FIGS. 2, 3 and 4A for an embodiment of the invention. A packaging structure for depression switches of the invention includes an electronic substrate 10 containing at least one switch electrode 11, a push-on switch 20 located on the electronic substrate 10 to connect the switch electrode 11 to generate a command signal, and a sealing member 30 to encase the push-on switch 20. The push-on switch 20 is located above the switch electrode 11 and has a first air chamber 21 formed between thereof and the electronic substrate 10 and a depressing portion 22 above the first air chamber 21. The depressing portion 22 is depressible for a depression distance P in the first air chamber 21 to trigger the switch electrode 11. The sealing member 30 has a fastening portion 31 to seal the push-on switch 20 on the electronic substrate 10 and a second air chamber 32 between the electronic substrate 10 and thereof communicating with the first air chamber 21.

In the embodiment, the switch electrode 11 includes a peripheral electrode 11*a* and a trigger electrode 11*b* located in the peripheral electrode 11*a*. The push-on switch 20 is a metal dome switch located above the switch electrode 11. The sealing member 30 is a film encasing the contact area of the push-on switch 20 and the electronic substrate 10 and the surrounding area thereof. The fastening portion 31 and the electronic substrate 10 form a bonding surface, or the fastening portion 31, the electronic substrate 10 and push-on switch 20 jointly form the bonding surface with an adhesive layer 311 formed thereon so that the push-on switch 20 can be securely positioned above the switch electrode 11 of the electronic substrate 10. The push-on switch 20 may also be sealed in the sealing member 30. The second air chamber 32 may be located in the fastening portion 31. The fastening portion 31 has a depressing zone 312 to cover the push-on switch 20. The second air chamber 32 and the first air chamber 21 are formed about the same size so that the second air chamber 32 can accommodate the air from the first air chamber 21.

Figure 4B:
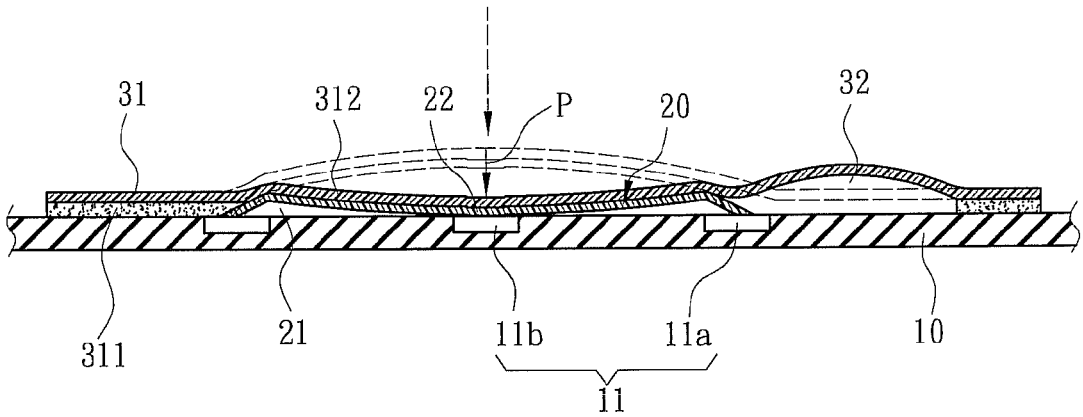

Referring to FIGS. 4A and 4B, when in use the depressing portion 22 of the push-on switch 20 is depressed for the depression distance P in the first air chamber 21 until reaching the trigger electrode 11*b* as shown in FIG. 4B. The peripheral electrode 11*a* and the trigger electrode 11*b* are connected through the push-on switch 20 to output the command signal. Meanwhile, the air in the first air chamber 21 is squeezed by the depressing portion 22 while it is moved at the depression distance P and flows into the second air chamber 32 to be saved without escaping. When the depressing force on the depressing portion 22 is released, the air saved in the second air chamber 32 flows back to the first air chamber 21. The pressure of the returning airflow can help the push-on switch 20 to return to the condition before depressing (shown in FIG. 4A). Thus response time of the push-on switch 20 can be shortened.

Figure 5:
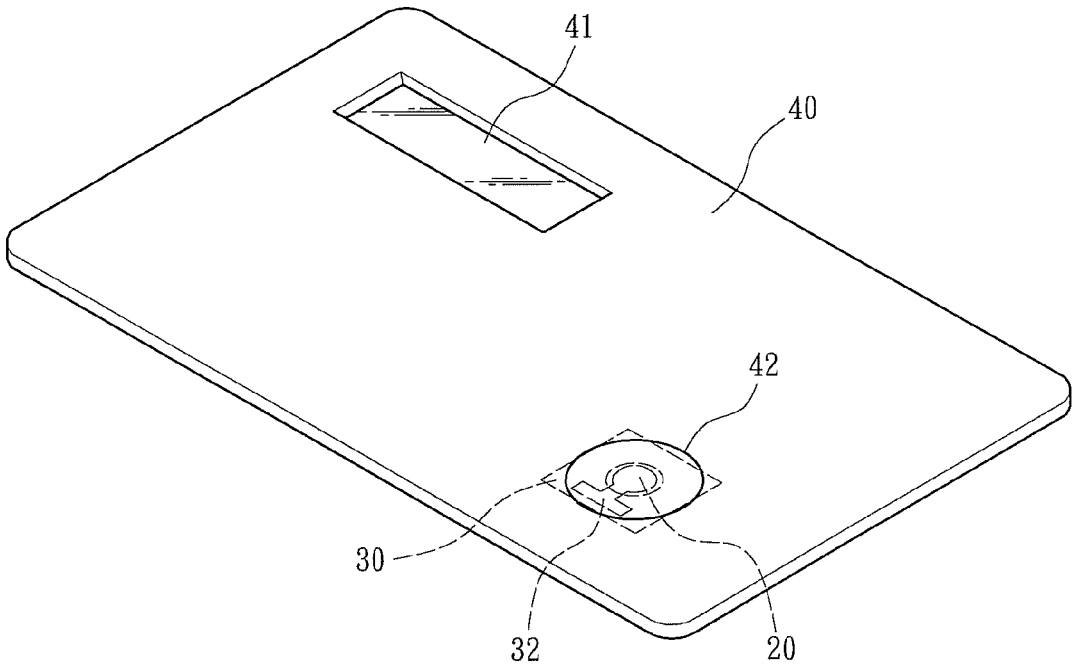
FIG. 5 is a schematic view of an embodiment of the packaging structure of the invention adopted on an IC card.

The invention can be used on various types electronic devices, such as an IC card 40 (referring to FIG. 5) or a RFID tag. Take the IC card 40 as an example, it may have a display screen 41 and a depression spot 42 to hold the packaging structure of the invention. Air in the push-on switch 20 can be released effectively during depressing to provide a desirable click feeling. The air also can be retained without losing, and damage of the structure of electronic device that might otherwise occur can be avoided.

As a conclusion, the packaging structure of the invention provides the first air chamber 21 in the push-on switch 20 and the second air chamber 32 that communicate with each other. During depressing operation of the push-on switch 20 air stored inside can be released without affecting click feeling. And the air saved in the second air chamber 32 can be retained without escaping or causing damage of the electronic device (such as the IC card 40). On the other hand, when the depressing force is released, the air saved in the second air chamber 32 can flow back to the first air chamber 21 to facilitate returning of the push-on switch 20 and shorten the response time of the push-on switch 20. It provides a significant improvement over the conventional techniques.

While the preferred embodiment of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A packaging structure for depression switches, comprising:

an electronic substrate which has at least one switch electrode;

a push-on switch located on the electronic substrate to connect the switch electrode to generate a command signal and form a first air chamber with the electronic substrate; and a sealing member which has a fastening portion to seal the push-on switch on the electronic substrate and a second air chamber formed with the electronic substrate to communicate only with the first air chamber;

wherein connection of the switch electrode through the push-on switch causes the first air chamber to be squeezed and air in the first air chamber to flow into the second air chamber.

2. The packaging structure of claim 1, wherein the second air chamber is located in the fastening portion.

3. The packaging structure of claim 1, wherein the second air chamber is formed in a size proximate to the first air chamber.

4. The packaging structure of claim 1, wherein the fastening portion and the electronic substrate form a bounding surface which has an adhesive layer located thereon.

5. The packaging structure of claim 1, wherein the fastening portion is bonded to the electronic substrate and push-on switch at a bonding surface with an adhesive layer formed thereon.

6. The packaging structure of claim 1, wherein the fastening portion has a depressing zone encasing the push-on switch.

7. An electronic device comprises the packaging structure of claim 1.

8. The electronic device of claim 7, wherein the electronic device is selectively an IC card or a RFID tag.

9. The packaging structure of claim 1, wherein the second air chamber is not formed over a switch.

* * * * *